US007202794B2

(12) United States Patent
Huseynov et al.

(10) Patent No.: US 7,202,794 B2
(45) Date of Patent: Apr. 10, 2007

(54) FLAME DETECTION SYSTEM

(75) Inventors: Javid J. Huseynov, Irvine, CA (US); Shankar Baliga, Irvine, CA (US); Gary D. Shubinsky, Mission Viejo, CA (US); Zvi Boger, Be'er Sheva (IL)

(73) Assignee: General Monitors, Inc., Lake Forest, CA (US)

( * ) Notice: Subject to any disclaimer, the term of this patent is extended or adjusted under 35 U.S.C. 154(b) by 185 days.

(21) Appl. No.: 10/894,570

(22) Filed: Jul. 20, 2004

(65) Prior Publication Data

US 2006/0017578 A1 Jan. 26, 2006

(51) Int. Cl.
*G08B 17/12* (2006.01)

(52) U.S. Cl. ..... 340/578; 340/577; 340/600; 340/506; 250/554

(58) Field of Classification Search ..... 340/577, 340/578, 600, 573.1, 506, 511; 431/12, 76, 431/79; 250/554, 339.1
See application file for complete search history.

(56) References Cited

U.S. PATENT DOCUMENTS

| | | | | |
|---|---|---|---|---|
| 4,709,155 | A | 11/1987 | Yamaguchi | 250/554 |
| 4,983,853 | A | 1/1991 | Davall | 250/554 |
| 5,289,275 | A | 2/1994 | Ishii | 348/154 |
| 5,339,070 | A | 8/1994 | Yalowitz | 340/578 |
| 5,495,112 | A | 2/1996 | Maloney | 250/554 |
| 5,495,893 | A * | 3/1996 | Roberts et al. | 169/37 |
| 5,510,772 | A | 4/1996 | Lasenby | 340/578 |
| 5,554,273 | A * | 9/1996 | Demmin et al. | 205/785 |
| 5,612,537 | A | 3/1997 | Maynard et al. | |
| 5,677,532 | A | 10/1997 | Duncan | 250/339.15 |
| 5,726,632 | A | 3/1998 | Barnes et al. | 340/577 |
| 5,751,209 | A * | 5/1998 | Werner et al. | 340/286.05 |
| 5,797,736 | A * | 8/1998 | Menguc et al. | 431/75 |
| 5,798,946 | A | 8/1998 | Khesin | 700/274 |
| 5,937,077 | A | 8/1999 | Chan | 382/100 |
| 6,011,464 | A * | 1/2000 | Thuillard | 340/506 |
| 6,150,659 | A * | 11/2000 | Baliga et al. | 250/339.15 |
| 6,184,792 | B1 | 2/2001 | Privalov | 340/578 |
| 6,247,918 | B1 * | 6/2001 | Forbes et al. | 431/12 |
| 6,261,086 | B1 | 7/2001 | Fu | 431/79 |
| 6,392,536 | B1 * | 5/2002 | Tice et al. | 340/506 |
| 6,473,747 | B1 | 10/2002 | Biggers et al. | 706/24 |
| 6,507,023 | B1 | 1/2003 | Parham | 250/339.15 |
| 6,740,518 | B1 * | 5/2004 | Duong et al. | 435/287.2 |
| 6,879,253 | B1 * | 4/2005 | Thuillard | 340/526 |
| 2002/0011570 | A1 | 1/2002 | Castleman | 250/339.15 |
| 2005/0056024 | A1 * | 3/2005 | Lieuwen et al. | 60/779 |

FOREIGN PATENT DOCUMENTS

EP 0366298 5/1990

(Continued)

OTHER PUBLICATIONS

Siemens, Algorex, Infrared flame detectors, DF1191, DF1192, Fire & Security Products, Document No. 1722_c_en_—, Edition Dec. 2003, 4 pages.

(Continued)

*Primary Examiner*—Jeffery Hofsass
*Assistant Examiner*—Hoi C. Lau
(74) *Attorney, Agent, or Firm*—Larry K. Roberts

(57) ABSTRACT

A flame detection system includes a plurality of sensors for generating a plurality of respective sensor signals. The plurality of sensors includes a set of discrete optical radiation sensors responsive to flame as well as non-flame emissions. An Artificial Neural Network may be applied in processing the sensor signals to provide an output corresponding to a flame condition.

43 Claims, 9 Drawing Sheets

FOREIGN PATENT DOCUMENTS

| | | | |
|---|---|---|---|
| EP | 0588753 | | 3/1994 |
| EP | 0 675 468 | A | 10/1995 |
| EP | 1233386 | A2 | 8/2002 |
| WO | WO 02/093525 | A1 | 11/2002 |
| WO | WO 2004/044683 | A | 5/2004 |

OTHER PUBLICATIONS

Siemens, DF11..,DF11-Ex Infrared flame detectors,Technical description,Planning Installation, Commissioning,Fire & Security Products, Doc No. e004938c, Edition Jul. 2003, 32 pgs.

International Search Report; Written Opinion of the International Searching Authority; PCT/US2005/013930 mailed Oct. 11, 2005.

Annon: "AlgoRex Infrarot Flammenmelder" Feb. 2003, Siemens Building Technologies, Munchen, XP002347435.

Wavelet Applications VII Apr. 26-28, 2000 Orlando, FL, USA, vol. 4056, Apr. 26, 2000, pp. 351-361, XP002347427 Proceedings of the SPIE—ISSN: 0277-786X.

Aube '01. 12th International Conference on Automatic Fire Detection Mar. 25-28, 2001 Gaithersburg, MD, USA, Mar. 25, 2001, pp. 191-200, XP002347428.

"Learning representations by back-propagating errors," David E. Rumelhart, Geoffrey E. Hinton & Ronald J. Williams; Nature, vol. 323, Oct. 9, 1986, pp. 533-536.

Application of Principal Component Analysis To The Design of Neural Networks; Hugo Guterman, Neural, Parallel & Scientific Computations 2 (1994) 43-54.

Fire Sentry Corporation, 2002, SS4-A UV/IR Digital Fire Detector; http: //www/firesentry.com/ ProductSS4FSC.asp#SS4A-A2.

http://www.micropack.co.uk/, CCTV FDS-101.

R. Hynds; Developments in Optical Fire Detection; Exploration and Production Forum, Aug. 23, 1998.

Minerva S200 Plus: Triple Waveband Infra-Red Flame Detection, data sheet, Thorn Security, 1998.

Nasa Commerce Business Daily Issue of Feb. 14, 1996, PSA#1531, Kennedy Space Center, FL 32899.

http://www.spectra-inc.com/sharpeye/ES-20201.htm, The triple spectrum SharpEye IR3 Flame Detector.

* cited by examiner

FLAME DETECTION SYSTEM

BACKGROUND OF THE DISCLOSURE

Flame detectors may comprise an optical sensor for detecting electromagnetic radiation, for example, visible, infrared or ultraviolet, which is indicative of the presence of a flame. A flame detector may detect and measure infrared (IR) radiation, for example in the optical spectrum at around 4.3 microns, a wavelength that is characteristic of the spectral emission peak of carbon dioxide. An optical sensor may also detect radiation in an ultraviolet range at about 200–260 nanometers. This is a region where flames have strong radiation, but where ultra-violet energy of the sun is sufficiently filtered by the atmosphere so as not to prohibit the construction of a practical field instrument.

Some flame detectors may use a single sensor, for an optical sensor, which operates at one of the spectral regions characteristic of radiation from flames. Flame detectors may measure the total radiation corresponding to the entire field of view of the sensor and measure radiation emitted by all sources of radiation in the spectral range being sensed within that field of view, including flame and/or non-flame sources which may be present. A flame detector may produce a "flame" alarm, intended to indicate the detection of a flame, when the level of combined radiation sensed reaches a predetermined threshold level, known or thought to be indicative of a flame.

Some flame detectors may produce false alarms which can be caused by an instrument's inability to distinguish between radiation emitted by flames and that emitted by other sources such as incandescent lamps, heaters, arc welding, or other sources of optical radiation. Single-wavelength flame detectors can also create false alarms triggered by other background radiation sources, including various reflections, such as solar or other light reflecting from a surface, such as water, industrial equipment, background structures and vehicles.

Various techniques have been developed which are intended to reduce false positives in flame detectors. Although these techniques may provide some improvement in false positive rates, the rate of false positives may still be higher than desired.

BRIEF DESCRIPTION OF THE DRAWINGS

Features and advantages of the invention will be readily appreciated by persons skilled in the art from the following detailed description of exemplary embodiments thereof, as illustrated in the accompanying drawings, in which.

DETAILED DESCRIPTION OF THE DISCLOSURE

Figure 1:
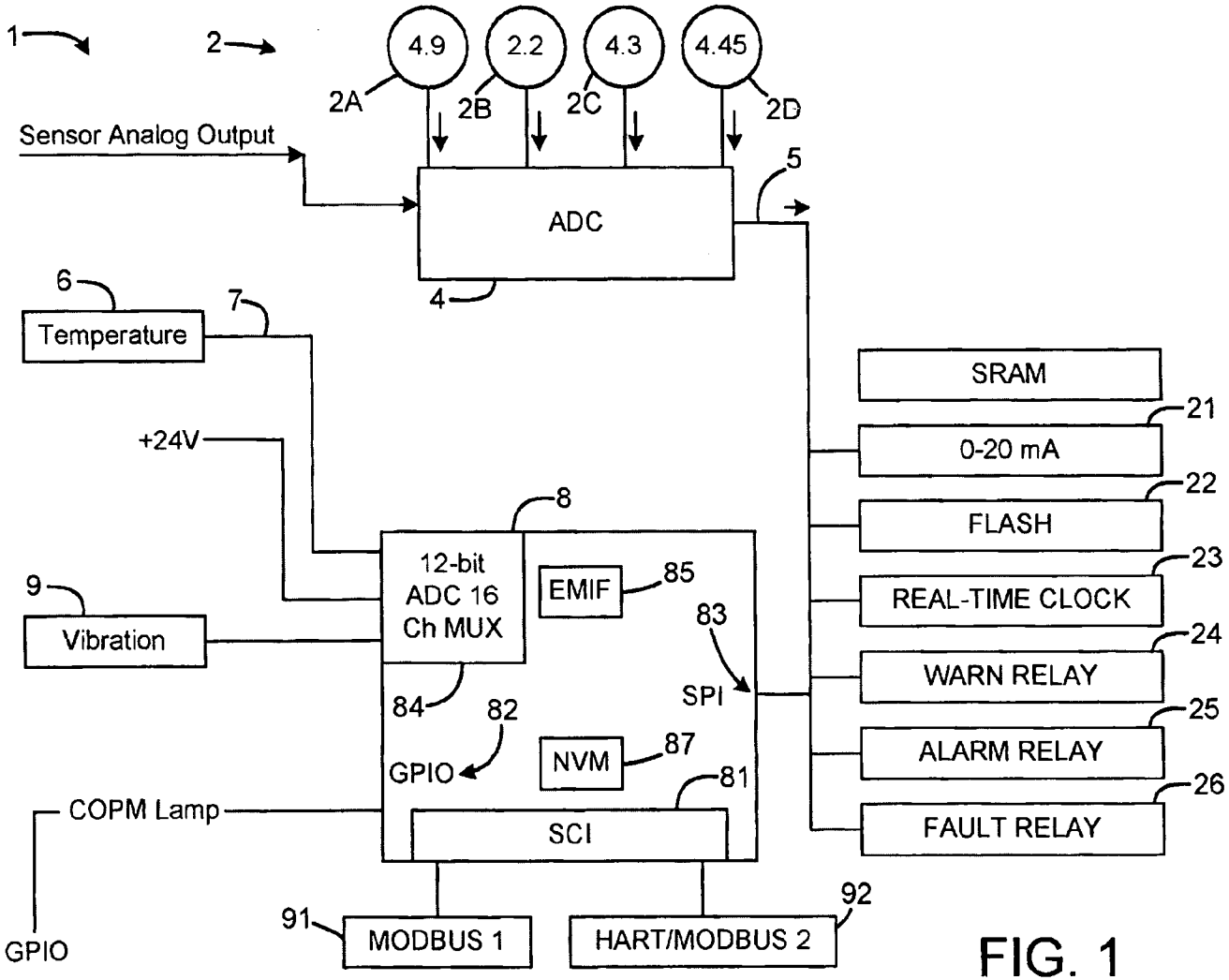
FIG. 1 is a schematic block diagram of an exemplary embodiment of a flame detection system.

In the following detailed description and in the several figures of the drawing, like elements are identified with like reference numerals.

FIG. 1 illustrates a schematic block diagram of an exemplary flame detector system 1 comprising a plurality of detectors 2 responsive to optical radiation to generate a plurality of respective analog detector signals 3. An analog-digital converter (ADC) 4 converts the analog detector signals 3 into digital detector signals 5. In an exemplary embodiment, the ADC 4 provides 24-bit resolution.

In an exemplary embodiment, the flame detector system 1 includes an electronic controller 8, e.g., a digital signal processor (DSP) 8, an ASIC or a microcomputer or microprocessor based system. In an exemplary embodiment, the signal processor 8 may comprise a Texas Instruments F2812 DSP, although other devices or logic circuits may alternatively be employed for other applications and embodiments. In an exemplary embodiment, the signal processor 8 comprises a dual universal asynchronous receiver transmitter (UART) as a serial communication interface (SCI) 81, a general-purpose input/output (GPIO) line 82, a serial peripheral interface (SPI) 83, an ADC 84 and an external memory interface (EMIF) 85 for a non-volatile memory, for example a flash memory 22. SCI MODBUS 91 or HART 92 protocols may serve as interfaces for serial communication over SCI 81. MODBUS and HART protocols are well-known standards for interfacing the user's computer or programmable logic controller (PLC).

In an exemplary embodiment, signal processor 8 receives the digital detector signals 5 from the ADC 4 through the serial peripheral interface SPI 83. In an exemplary embodiment, the signal processor 8 is connected to a plurality of interfaces through the SPI 83. The interfaces may include an analog output 21, flash memory 22, a real time clock 23, a warning relay 24, an alarm relay 25 and/or a fault relay 26. In an exemplary embodiment, the analog output 21 may be a 0–20 mA output. In an exemplary embodiment, a first current level at the analog output 21, for example 20 mA, may be indicative of a flame (alarm), a second current level at the analog output 21, for example 4 mA, may be indicative of normal operation, e.g., when no flame is present, and a third current level at the analog output 21, for example 0 mA, may be indicative of a system fault, which could be caused by conditions such as electrical malfunction. In other embodiments, other current levels may be selected to represent various conditions. The analog output can be used to trigger a flame suppression unit, in an exemplary embodiment.

In an exemplary embodiment, the flame detector system 1 may also include a temperature detector 6 for providing a temperature signal 7, indicative of an ambient temperature of the flame detector system for subsequent temperature compensation. The temperature detector 6 may be connected to the ADC 84 of the signal processor 8, which converts the temperature signal 7 into digital form. The system 1 may also include a vibration sensor for providing a vibration signal indicative of a vibration level experienced by the system 1. The vibration sensor may be connected to the ADC 84 of the signal processor 8, which converts the vibration signal into digital form.

In an exemplary embodiment, the signal processor 8 is programmed to perform pre-processing and artificial neural network processing, as discussed more fully below.

In an exemplary embodiment, the plurality of detectors 2 comprises a plurality of spectral sensors, which may have different spectral ranges and which may be arranged in an array. In an exemplary embodiment, the plurality of detectors 2 comprises optical sensors sensitive to multiple wavelengths. At least one or more of detectors 2 may be capable of detecting optical radiation in spectral regions where flames emit strong optical radiation. For example, the sensors may detect radiation in the UV to IR spectral ranges. Exemplary sensors suitable for use in an exemplary flame detection system 1 include, by way of example only, silicon, silicon carbide, gallium phosphate, gallium nitride, and aluminum gallium nitride sensors, and photoelectric tube-type sensors. Other exemplary sensors suitable for use in an exemplary flame detection system include IR sensors such as, for example, pyroelectric, lead sulfide (PbS), lead selenide (PbSe), and other quantum or thermal sensors. In an exemplary embodiment, a suitable UV sensor operates in the 200–400 nanometer region. In an exemplary embodiment, the photoelectric tube-type sensors and/or aluminum gallium nitride sensors each provide "solar blindness" or an immunity to sunlight. In an exemplary embodiment, a suitable IR sensor operates in the 4.3-micron region specific to hydrocarbon flames, and/or the 2.9-micron region specific to hydrogen flames.

In an exemplary embodiment, the plurality of sensors 2 comprise, in addition to sensors chosen for their sensitivity to flame emissions (e.g., UV, 2.9 microns and 4.3 microns), one or more sensors sensitive to different wavelengths to help uniquely identify flame radiation from non-flame radiation. These sensors, known as immunity sensors, are less sensitive to flame emissions, however, provide additional information on infrared background radiation. The immunity sensor or sensors detects wavelengths not associated with flames, and may be used to aid in discriminating between flame radiation from non-flame sources of radiation. In an exemplary embodiment, an immunity sensor comprises, for example, a 2.2-micron wavelength detector. A sensor suitable for the purpose is described in U.S. Pat. No. 6,150,659.

Figure 1A:
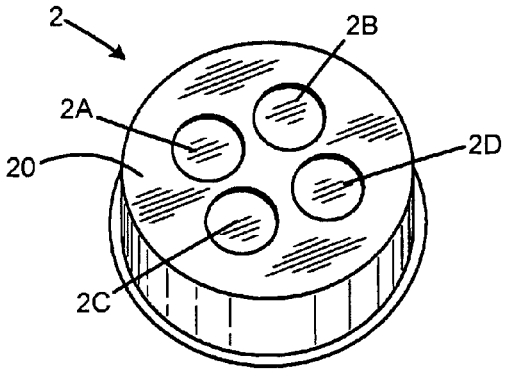
FIG. 1A illustrates an exemplary sensor housing structure suitable for use in housing the optical sensors of a flame detection system.

In the exemplary embodiment of FIG. 1, the flame detection system 1 comprises an array of four sensors 2A–2D, which incorporates spectral filters respectively sensitive to radiation at 4.9 um (2A), 2.2 um (2B), 4.3 um (2C) and 4.45 um (2D). In an exemplary embodiment, the filters were selected to have narrow operating bandwidths, e.g. on the order of 100 nm, so that the sensors are only responsive to radiation in the respective operating bandwidths, and block radiation outside of the operating bands. In an exemplary embodiment, the optical sensors 2 are packaged closely together as a cluster or combined within a single detector package. This configuration leads to a smaller, less expensive sensor housing structure, and also provides more unified optical field of view of the instrument. An exemplary detector housing structure suitable for the purpose is the housing for the detector LIM314, InfraTec GmbH, Dresden, Germany. FIG. 1A illustrates an exemplary sensor housing structure 20 suitable for use in housing the sensors 2A–2D in an integrated unit.

Figure 2:
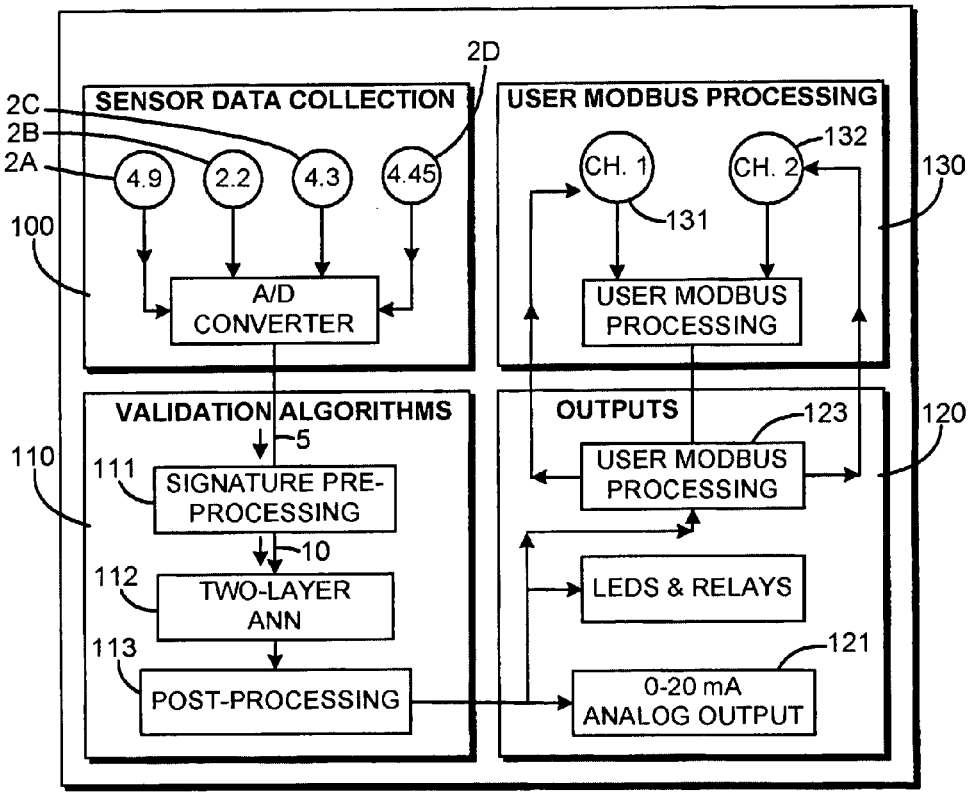
FIG. 2 is a functional block diagram of an exemplary flame detection system.

FIG. 2 is an exemplary functional block diagram of an exemplary sensor system. The system includes a sensor data collection function, which collects the analog sensor signals from the sensors, e.g. sensors 2A–2D, and converts the sensor signals into digital form for processing by the digital signal processor. Validation algorithms are then applied to the sensor data, including signal pre-processing, Artificial Neural Network (ANN) processing and post-processing to determine the sensor state. The output of the post-processing is then provided to the analog output and various status LEDs, control relays, and external communication interfaces such as, MODBUS, HART, CANBus, FieldBus, or Ethernet protocols operating over fiber optic, serial, infrared, or wireless media. In the event of a fire, an electronic analog signal provides indication of the flame condition, and a relay can be activated to provide a warning or activate a fire suppression system. The output of the post-processing optionally may also be provided to the user via one of the communication interfaces (MODBUS, HART, CANBus, FieldBus, or Ethernet protocols operating over fiber optic, serial, infrared, or wireless media) allowing the user to analyze the data and react via his fire suppression system.

Figure 3:
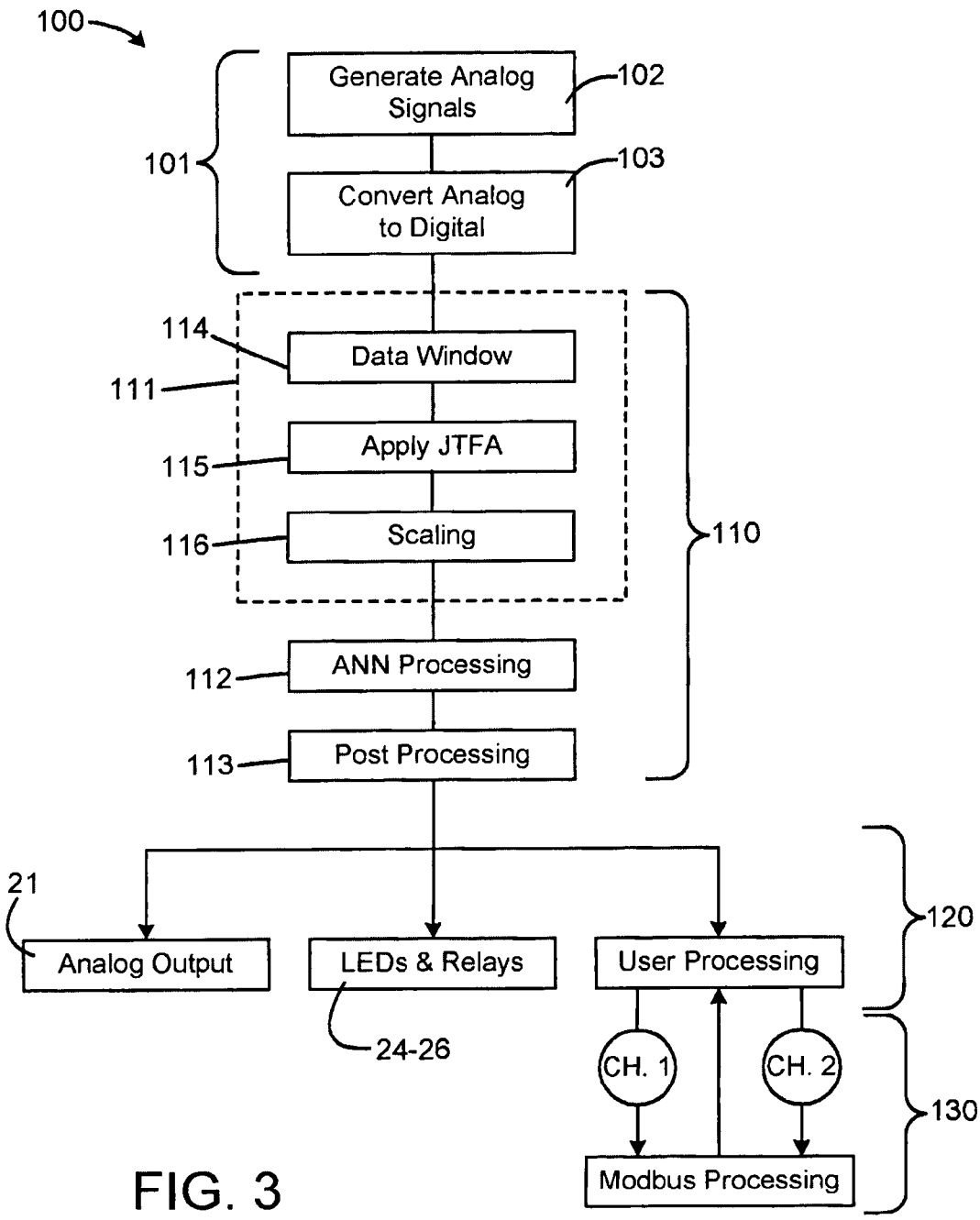
FIG. 3 is an exemplary flow diagram of a method for detecting flame.

FIG. 3 illustrates a functional diagram of an exemplary embodiment of a method 100 of operating the flame detection system 1 of FIG. 1. In an exemplary embodiment, the method 100 comprises collecting (101) sensor data, applying validation algorithms (110), outputting data (120) and user processing (130).

In an exemplary embodiment, collecting (101) sensor data comprises generating (102) analog signals and converting (103) the analog signals into digital form. In an exemplary embodiment, the sensors 2 and temperature sensor 6 (FIG. 1) generate (102) analog signals, and the ADC 4 and ADC 84 (FIG. 1) convert (103) the analog signals into digital form for further processing by the DSP 8 (FIG. 1).

In an exemplary embodiment, applying validation algorithms 110 comprises pre-processing (111) digital signals, artificial neural network (ANN) processing (112) of the pre-processed signals, and post-processing (113) of output signals from the ANN. In an exemplary embodiment, the pre-processing 111, the ANN processing 112, and the post processing 113 are all performed by the signal processor 8 (FIG. 1).

Figure 4:
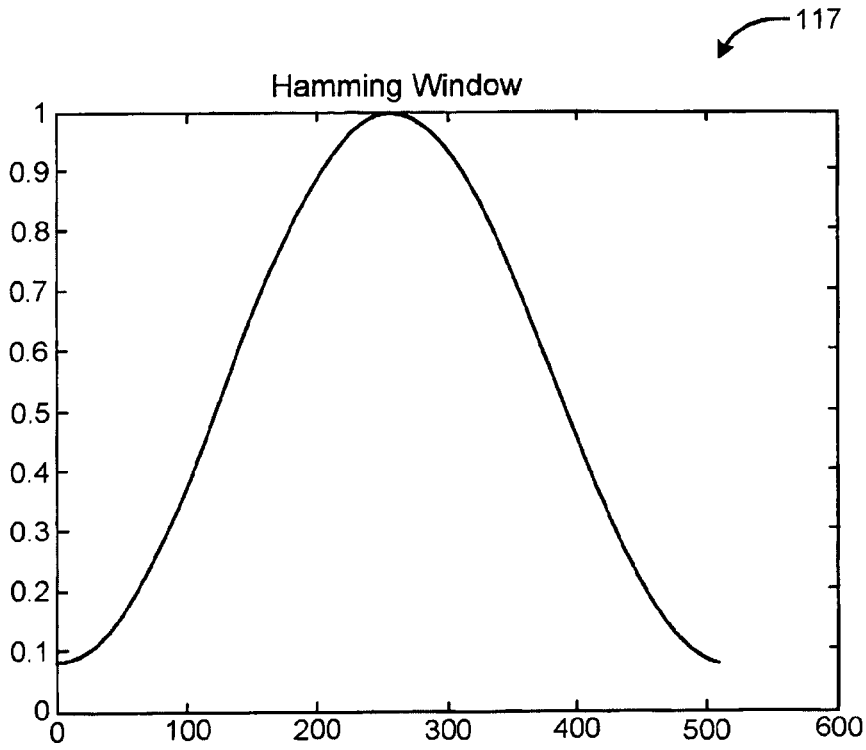
FIG. 4 illustrates an exemplary data windowing function.

In an exemplary embodiment, the analog signals from the optical sensors are periodically converted to digital form by the ADC 4. The information from one or more temperature and vibration sensors can also be used as additional ANN inputs. The pre-processing (111) of the digitized signals is applied to the digitized sensor signals. In an exemplary embodiment, an objective of the pre-processing step is to establish a correlation between frequency and time domain of the signal. In an exemplary embodiment pre-processing comprises applying (114) a data windowing function, and applying (115) Joint Time-Frequency Analysis (JTFA) functions, such as, Discrete Fourier Transform, Gabor Transform, or Discrete Wavelet Transform (116). In an exemplary embodiment, applying (114) a data windowing function comprises applying one of a Hanning, Hamming, Parzen, rectangular, Gauss, exponential or other appropriate data windowing function. FIG. 4 illustrates an exemplary data window function 117. In this embodiment, the data window function 117 comprises a Hamming window function. FIG. 4 illustrates a cosine type function:

$$W^{Hm} = \frac{1}{2}\left\{1.08 - 0.92\cos\left(\frac{2\pi n}{N-1}\right)\right\}$$

where N is number of sample points (e.g. 512) and n is between 1 and N.

In an exemplary embodiment, data preprocessing, entitled windowing 117 is applied (114) to a raw input signal before applying (115) a JTFA function. This data windowing function alleviates spectral "leakage" of the signal and thus improves the accuracy of the ANN classification.

Figure 5:
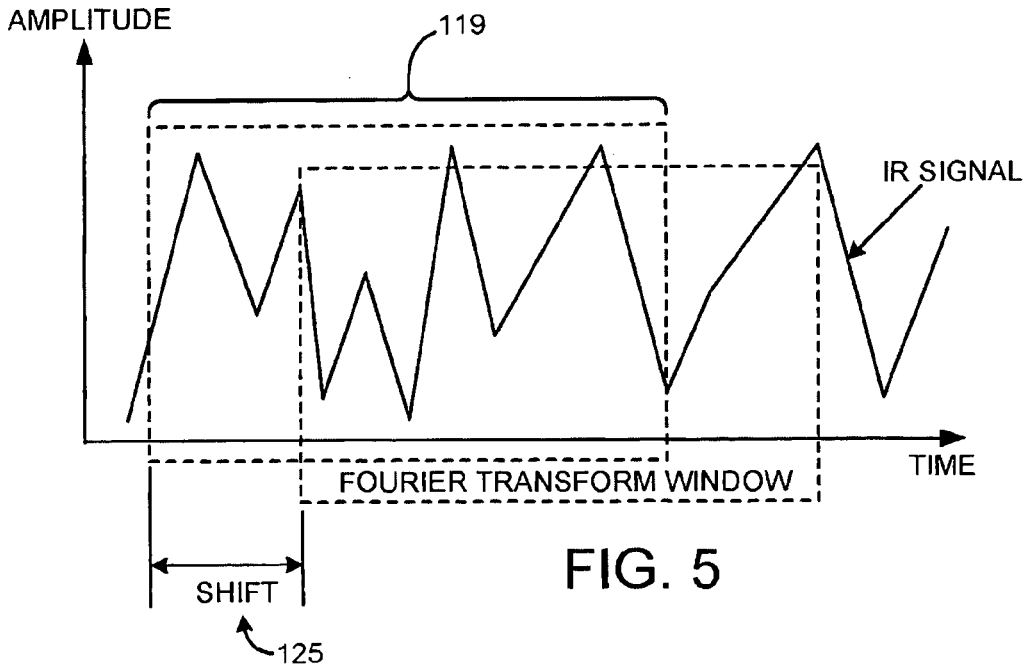
FIG. 5 illustrates an exemplary embodiment of applying JTFA to a digital signal.

Referring again to FIG. 3, in an exemplary embodiment, (115) JTFA encompasses a Short Time Fourier Transform (STFT) with a shifting time window (also known as Gabor transform). Other functions can also alternatively be applied for JTFA including a Discrete Fourier Transform (DFT) or a Discrete Wavelet Transform (DWT). FIG. 5 illustrates a graphical representation of (115) JTFA application. A data window 119 is shifted (125) at a fixed rate. After each shift 125, the Fourier Transform of the signal segment is computed. Each shift 125 generates an input vector, which is then used as an input for ANN processing 112. In addition to the optical sensor inputs, the exemplary embodiment includes the inputs from temperature and vibration sensors. The main purpose for including vibration and temperature sensors is to provide robustness of the instruments under highly adverse industrial conditions.

In an exemplary embodiment, coefficients and algorithms used for the JTFA, windowing function, the scaling function and the ANN are stored in memory. In an exemplary embodiment, the coefficients may be stored in an external memory, for example the non-volatile FLASH memory 22 (FIG. 1), or EEPROM memory. In an exemplary embodiment, the algorithms used for the JTFA, windowing function, scaling function and the ANN may be written to an internal memory, for example an internal non-volatile FLASH memory 87 of the DSP 8.

Referring again to FIG. 3, in an exemplary embodiment, the further signal processing comprises (111) normalizing (116) the JTFA output, prior to ANN to provide more scalable data input for the ANN processing. In an exemplary embodiment, the output from the JTFA function comprises a vector where each vector value represents a distinct ANN input to be scaled. For example, in one embodiment, the digitized output from each sensor is processed by a 512-point Fast Fourier Transform (FFT), and so the inputs to the ANN include 512 values for each sensor. From each value, a scaling coefficient (mean) is subtracted, and the result divided by a second coefficient (standard deviation). These coefficients are calculated during the pre-processing of the training set for the ANN.

Figure 6A:
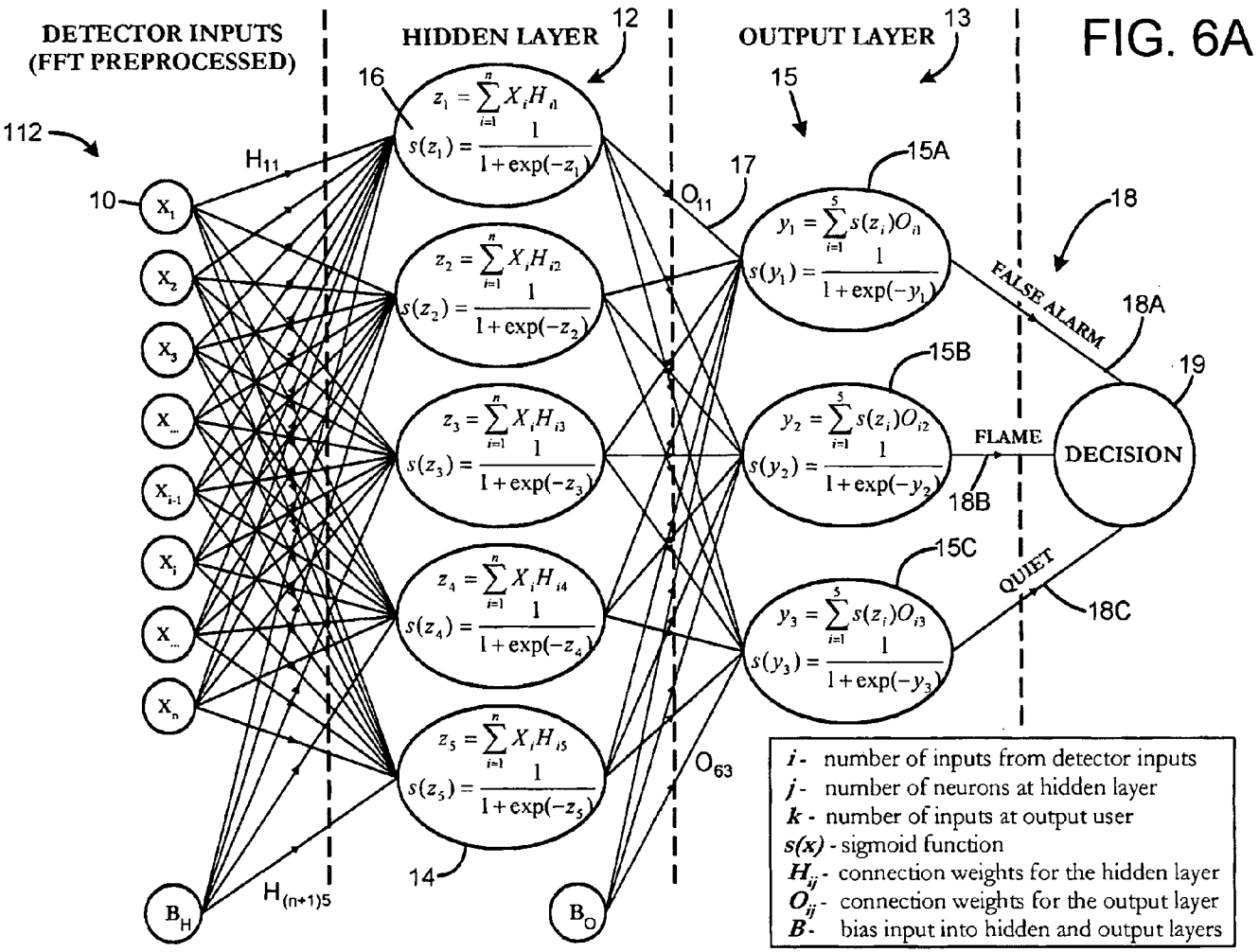
FIGS. 6A and 6B illustrate exemplary embodiments of ANN processing.

FIG. 6A illustrates a functional block diagram of an exemplary embodiment of ANN processing 112. ANN processing 112 may comprise two-layer ANN processing. In an exemplary embodiment, ANN processing 112 comprises of receiving a plurality of pre-processed signals 10 ($x_1$–$x_i$) (corresponding to the FFT processed and scaled signals from the detectors 2A–2D, 6 and 9 shown in FIG. 1), a hidden layer 12 and an output layer 13. In other exemplary embodiments, ANN processing 112 may comprise a plurality of hidden layers 12.

Figure 6B:
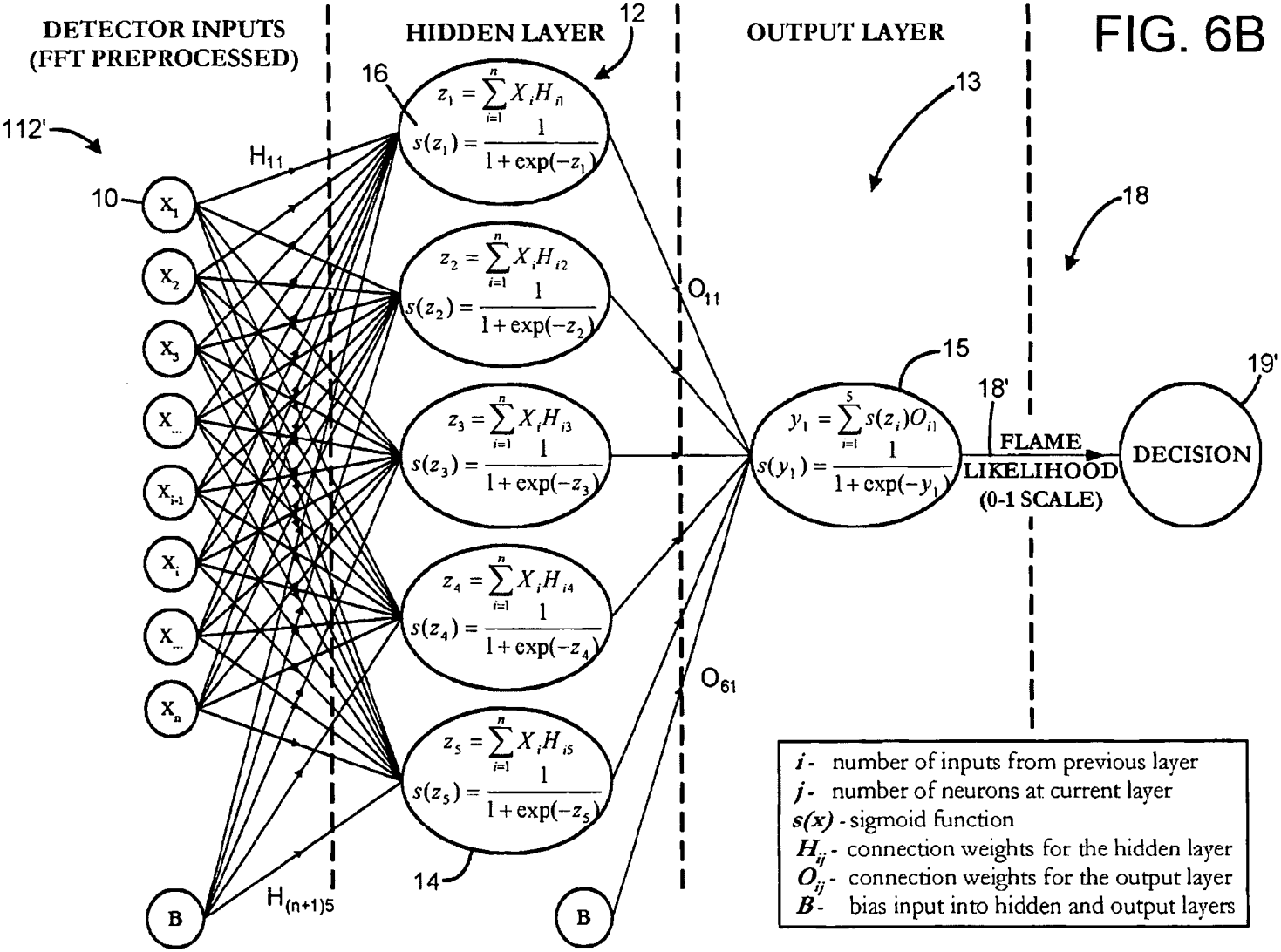
Figure 8:
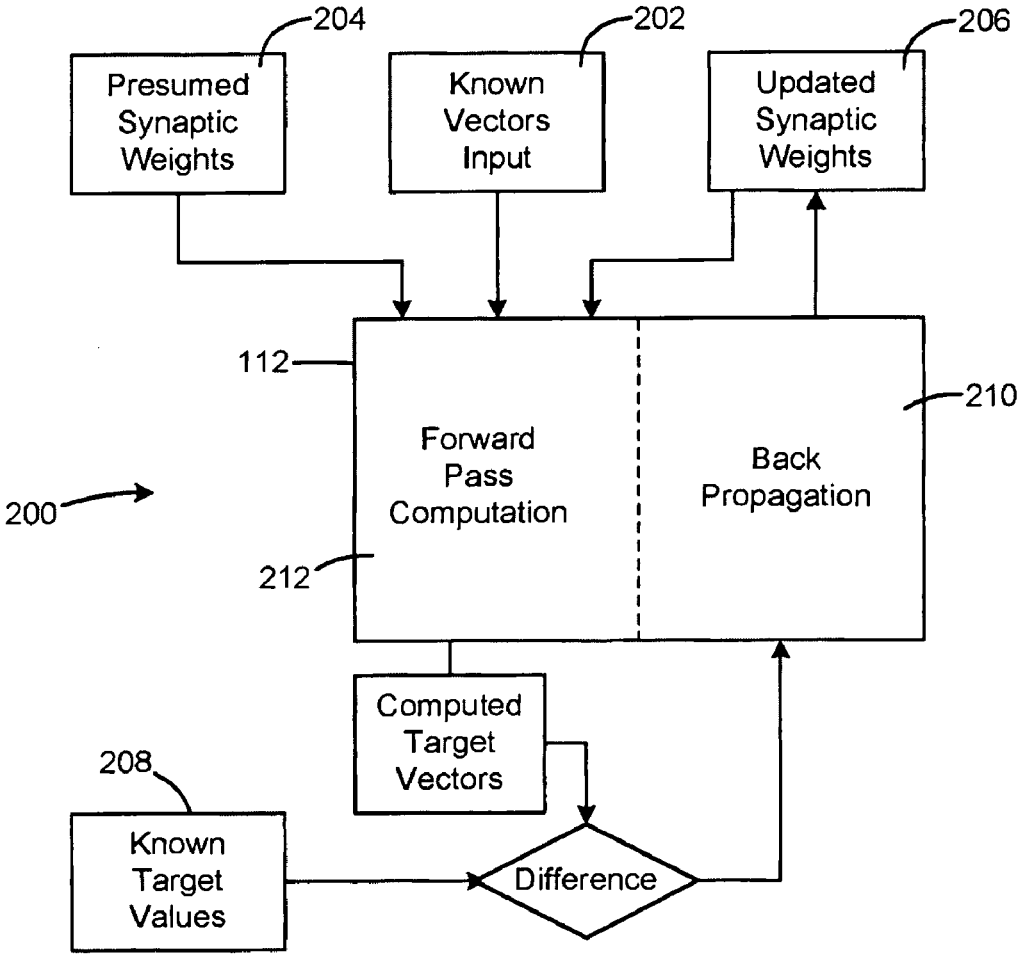
FIG. 8 illustrates an exemplary embodiment of a method for training an ANN.

In an exemplary embodiment, the hidden layer 12 comprises a plurality of artificial neurons 14, for example from four to eight neurons. The number of neurons 14 may depend on the level of training and classification achieved by the ANN processing 112 during training (FIG. 8). In an exemplary embodiment, the output layer 13 comprises a plurality of targets 15 (or output neurons) corresponding to various conditions, including, for example, flame, non-flame radiation source (welding, hot object), ambient or background radiation (sunlight, optical reflections). The number of targets 15 may be, for example, from one to four. The exemplary embodiment of FIG. 6A employs three target neurons. The exemplary embodiment of FIG. 6B employs one target neuron 15, which outputs a flame likelihood value 18' to decision processing 19'.

In an exemplary embodiment, the external flash memory (FIG. 1) holds synaptic connection weights $H_{ij}$ for the hidden layer 12 and synaptic connection weights $O_{jk}$ for the output layer 13. In an exemplary embodiment, the signal processor 8 sums the plurality of pre-processed signals 10 at neuron 14, each multiplied by the corresponding synaptic connection weight $H_{ij}$. A non-linear activation (or squashing) function 16 ($f(z_i)$) is then applied to the resultant weighted sum $z_i$ for each of the plurality of neurons 14. In an exemplary embodiment, the activation function 16 is a unipolar sigmoid function ($s(z_i)$).

Figure 7A:
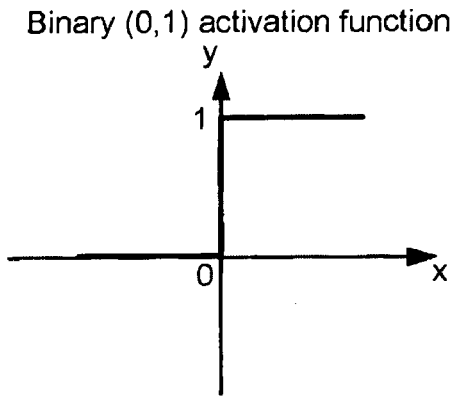
FIGS. 7A and 7B illustrate exemplary activation functions for the ANN processing of FIG. 6.
Figure 7B:
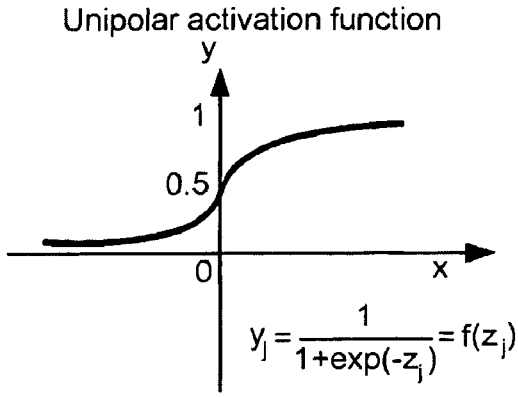

FIGS. 7A–7B show exemplary embodiments of activation functions, with FIG. 7A showing a binary (0, 1) activation function and FIG. 7B a unipolar activation function. In other embodiments, the activation function 16 can be a bipolar activation function or other appropriate function. In an exemplary embodiment, a bias $B_h$, is also an input to the hidden layer 12. In an exemplary embodiment, the bias $B_h$ has the value of one.

Referring again to FIG. 6A, in an exemplary embodiment, the neuron outputs 17 ($s(z_i)$) are input to the output layer 13. In an exemplary embodiment, a bias Bo is also an input to the output layer 13. In an exemplary embodiment, the outputs 17 ($s(z_i)$) are each multiplied by a corresponding synaptic connection weight $O_{jk}$ and the corresponding results are summed for each target 15 in the output layer 13, resulting in a corresponding sum $y_j$. In an exemplary embodiment, a function $s(y_k)$ is applied to the sums $y_j$. In an exemplary embodiment, the function ($s(y_k)$ is a sigmoid function $s(y_k)$, similar to the sigmoid function shown in FIG. 7B. In other exemplary embodiments, the function $f(y_k)$ could be a bipolar function. In an exemplary embodiment, the results $s(y_k)$ for each target 15A–15C correspond to an ANN output signal 18. For each target 15A–15C, the value of the corresponding output signal 18A–18C corresponds to the likelihood of the corresponding target 15 condition, i.e. "false alarm," "flame" or "quiet." In an exemplary embodiment, the output signals 18 are used for making a final decision 19.

Thus, as depicted in FIG. 6A, the signal-processed inputs $X_i$ are connected to hidden neurons, and the connections between input and hidden layers are assigned weights $H_{ij}$. At every hidden neuron, the multiplication, summation and sigmoid function are applied in the following order.

$$Z_j = \sum_{i=1}^{n} X_i H_{ij}$$

$$S(Z_j) = \frac{1}{1 + e^{-Z_j}}$$

The outputs of sigmoid function $S(Z_j)$ from the hidden layer are introduced to the output layer. The connections between hidden and output layers are assigned weights $O_{jk}$.

Now at every output neuron multiplication, in this exemplary embodiment, summation and sigmoid function are applied in the following order:

$$Y_k = \sum_{i=1}^{n} S(Z_j)O_{jk}$$

$$S(Y_k) = \frac{1}{1 + e^{-Y_k}}$$

In an exemplary process of ANN training, the connection weights $H_{ij}$ and $O_{jk}$ are constantly optimized by Back Propagation (BP). In an exemplary embodiment, the BP algorithm applied is based on mean root square error minimization for ANN training. These connection weights are then used in ANN validation, to compute the ANN outputs $S(Y_k)$, which are used for final decision making. Multi-layered ANNs and ANN training using BP algorithm to set synaptic connection weights are described, e.g. in Rumelhart, D. E., Hinton, G. E. & Williams, R. J., Learning Representations by Back-Propagating Errors, (1986) Nature, 323, 533–536.

In an exemplary embodiment illustrated in FIG. 6A, the ANN processing 112 output values 18A–18C represent a percentage likelihood of non-flame events, flame events, and quiet conditions, respectively. A threshold applied to the output, sets the limit of the likelihood, above which an alarm condition is indicated. In the example shown in FIG. 9, a flame neuron output above 0.8 indicates a strong likelihood of flame, whereas a smaller output indicates a strong likelihood of non-flame or quiet condition.

In an exemplary embodiment, the ANN coefficients $H_{ij}$, $O_{jk}$ comprise a set of relevance criteria between various inputs and targets. This information is used to identify inputs that are most relevant for successful classification and eliminating inputs that degrade the classification capability. The ANN processing provides an output corresponding to the actual conditions represented by the inputs received from the sensors 2, 6. In an exemplary embodiment, the coefficients comprise a unique "fingerprint" of a particular flame-background combination. In an exemplary embodiment, the coefficients $H_{ij}$, $O_{jk}$ are established during training (FIG. 8) so that the ANN processing 112 output will accurately correspond to the conditions, including various combinations of flame, non-flame and/or background conditions, sensed by the detectors 2 (FIG. 1).

Figure 9:
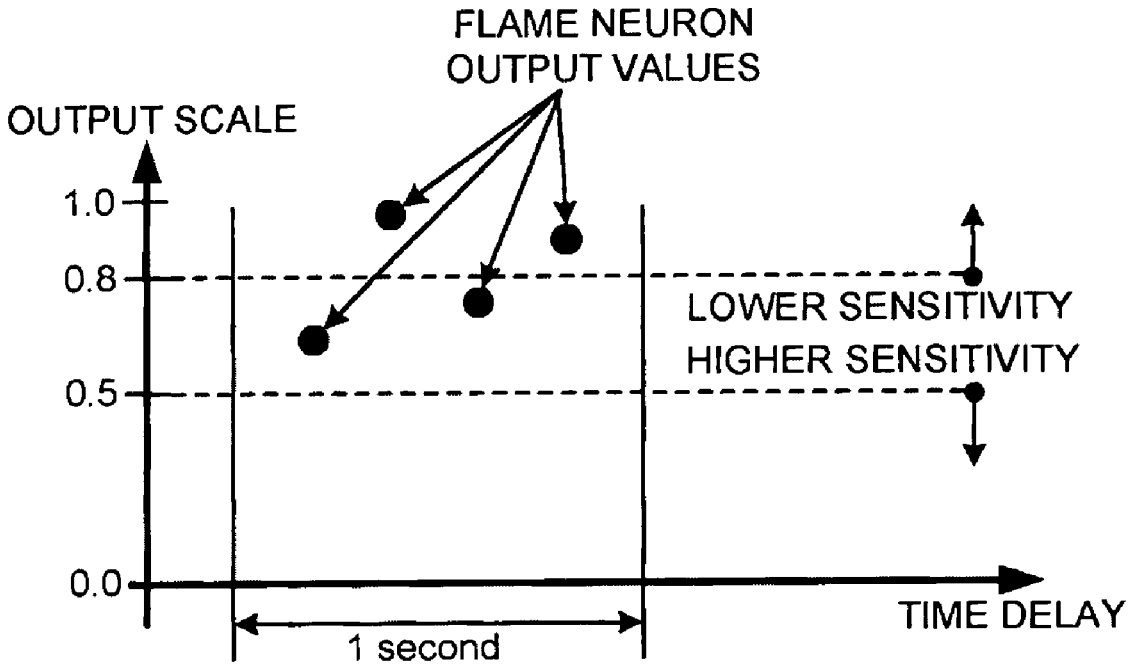
FIG. 9 illustrates an exemplary embodiment of post-processing the output signals from an ANN.

In an exemplary embodiment, the method 100 of operating a flame detection system comprises the post-processing (113) of the ANN output signals. FIG. 9 illustrates an exemplary post-processing analysis. Post-processing is performed on output values from the plurality of ANN output signals 18A–18C (FIG. 6A). A post-processing function is applied to at least one of the values and may be applied to a plurality of the values or all of the values. In an exemplary embodiment, the function applied to a particular value may depend on the characteristics and/or specifications of the flame detector. For example, the post-processing function may depend on the sensitivity, maximum and minimum flame detection ranges, false alarm rejection ranges, and/or the detector's response time. In an exemplary embodiment, post-processing includes applying thresholds for the ANN output signal values and may limit the number of times that a threshold may be exceeded before indicating a warning or an alarm condition. For example, it may be desirable to have the output signal 18B for the flame neuron exceed a threshold four times within a given time period, for example one second, before the alarm condition is output. This limits the likelihood of an isolated spurious input condition and/or transient to be interpreted as a flame condition thus causing a false alarm.

In an exemplary embodiment, outputting signals 120, can comprise one or more of the following, providing 121 an analog output 21 (FIGS. 1–3), sending 122 signals to indicators, for example LED indicators and/or relays 24, 25, 26 (FIG. 1), and providing 123 an output to a user via communication interface 91, 92 (FIG. 1). In an exemplary embodiment, the LED indicators may indicate a flame condition or normal operation. For example, a red LED may indicate a flame condition and a green LED may indicate normal operation. In an exemplary embodiment, the user MODBUS processing comprises processing (131) a first user MODBUS output, processing (132) a second user MODBUS output and outputting (133) a signal to the user MODBUS output 123. In an exemplary embodiment, the MODBUS interfaces allow the user to set parameters, update ANN coefficients and collect signal and ANN output information.

In an exemplary embodiment, the coefficients $H_{ij}$ and $O_{jk}$ are established by training. FIG. 8 illustrates an exemplary training process 200 for an ANN processing 112. In an exemplary embodiment, the training process 200 is conducted prior to putting a flame detection system 1 (FIG. 1) into service for detecting flames. Training comprises providing known input vectors 202 and known target vectors 208 shown as target "values" in FIG. 8. The known input vectors 202 and target vectors 208 are introduced to a back propagation (BP) algorithm 210 operating on the ANN 112. In an exemplary embodiment, known input vectors 202 may comprise signals corresponding to pre-processed signals 10 (FIG. 6) representative of a given flame condition/background condition. In an exemplary embodiment, the known input vectors are the result of extensive indoor and outdoor tests conducted as described below, i.e. the results of data collected using the sensor array 1 in a training setup. In an exemplary embodiment, an ANN may be trained by exposing the flame detector to a plurality of flame/non-flame/background combinations. In an exemplary embodiment, a particular ANN may be trained using as many as two hundred or more combinations, although the fewer or greater numbers of combinations may be employed, depending on the application. In an exemplary embodiment, the known target vectors 208 may comprise either true or false (one or zero) values corresponding to the target conditions 15 (FIG. 6A). In an exemplary embodiment, even though the ANN is trained on artificially created or pre-selected field conditions, the exemplary system may effectively extrapolate conditions specific to particular flames sources not part of initial training.

Assuming a random starting set of synaptic connection weights $H_{ij}$, $O_{jk}$, the algorithm computes (212) a forward-pass computation through the ANN and outputs output signals 18. The output signals 18 are compared to the known target vectors 208 and the discrepancy between the two is input back into the ANN for back propagation. In an exemplary embodiment, the known target vectors 208 are obtained in the presence of a known test condition. The discrepancy between the calculated output signals 18 and the known target vectors 208 are then propagated back through the BP algorithm to calculate updated synaptic connection weights $H_{ij}$, $O_{jk}$. This training of the neural network is performed after data collection of the training set is complete. This procedure is then repeated, using the updated synaptic connection weights as input to the forward pass computation of the ANN.

Each iteration of the forward-pass computation and corresponding back propagation of discrepancies is referred to as an epoch, and in an exemplary embodiment is repeated recursively until the value of discrepancy converges to a certain, pre-defined threshold. The number of epochs may for example be some predetermined number, or the threshold may be some error value.

In an exemplary embodiment, during training, the ANN establishes relevance criteria between the distinct inputs and targets, which correspond to the synaptic weights $H_{ij}$ and $O_{jk}$. This information is used to identify the fingerprint of a particular flame-background combination.

In an exemplary embodiment, the ANN may be subjected to a validation process after each training epoch. Validation can be performed to determine the success of the training. In an exemplary embodiment, validation comprises having the ANN calculate targets from a given subset of training data. The calculated targets are compared with the actual targets. The coefficients can be loaded into a flame detector system for field testing to perform validation.

In an exemplary embodiment, the training for the ANN employs a set of robust indoor, outdoor, and industrial site tests. Data from these tests can be used in the same scale and format for training. The ANN training can be performed on a personal or workstation computer, with the digitized sensor inputs provided to the computer. The connection weights from standardized training can be loaded onto the manufactured sensor units of a particular model of a flame detector system.

In an exemplary embodiment, an outdoor flame booth was used for outdoors arc welding and flame/non-flame combination tests. It has been observed for an exemplary embodiment that training on butane lighter and propane torch indoors, and n-heptane flame outdoors is sufficient to detect methane, gasoline and all other flames without training on those particular phenomena. Additional training data can be collected on a site-by-site basis, however, an objective of standard tests is to reduce or eliminate custom data collection, altogether.

The following Tables 1–2 list the names and conditions of standard indoor and outdoor tests employed in an exemplary baseline training of an ANN for the flame detector. In an exemplary embodiment, there are four different targets: quiet, flame, false alarm, and a test lamp (TL 103). The quiet, flame and false alarm targets are as described above regarding the ANN of FIG. 6A. The test lamp target is used to train a set of test lamp ANN coefficients, useful for testing a flame detector in the field. In an exemplary embodiment, the test lamp can be treated either as flame or false alarm depending on the mode set on the flame detector instrument by the user. In the test lamp mode, which may be selected by a switch on the detector housing, the test coefficients are used by the ANN, and the instrument bypasses the alarm mode, such as the analog output and relays. The instrument is exposed to the test lamp. Test lamp recognition is displayed via the status LEDs and MODBUS to indicate the instrument is functional.

The order in which tests are arranged for input can also impact the training of the neural network. An exemplary order of the tests, which trains ANN for experimentally best classification, is shown in Table 3. Each test is 30-seconds (3000-samples) long in this example.

TABLE 1

Standard Indoors Tests.

| Test Names | Ranges | Number of Tests Per Range | Target |
|---|---|---|---|
| Butane lighter | 0, 1, 3, 5, 10 ft | 1 | Flame |
| 5 in Propane Flame for 0.021 orifice | 10, 15, 20 ft | 1 | Flame |
| Flashlight | 0, 1, 5, 10 ft | 1 | False |
| TL103 Lamp | 0, 1, 5, 10, 20 ft | 1 | Lamp |
| Random hand waving | — | 4 | False |
| Random body motion | — | 2 | False |
| No modulation indoors | — | 4 | Quiet |
| Random hand waving with background non-flame heat source (hot plate) | 5 ft | 1 | False |
| Random hand waving with background flame source (butane lighter) | 5 ft | 1 | Flame |
| Vibration | 10–150 Hz @ 2 G and 1 mm displacement | 6–8 | False |
| Temperature | −40 to +85 C. | 3–4 | False |

TABLE 2

Standard Outdoors Tests.

| Test Name | Ranges | Number of Tests Per Range | Target |
|---|---|---|---|
| n-Heptane flame in 12" × 12" pan (with sunlight) | 100, 150, 210 ft | 2 | Flame |
| Arc welding rods 6010, 6011, 6012, 7014, 7018 (in flame booth) | 15 ft | 1 | False |
| Arc welding rods 6010, 6011, 6012, 7014, 7018 (in flame booth) with n-Heptane flame on the side | Arc welding - 15 ft<br>n-Heptane flame - 20 ft | 1 | Flame |
| Mirrored sunlight | 5 ft | 1 | False |
| Mirrored sunlight with running water hose | 10 ft | 1 | False |
| No modulation outdoors | — | 10 | Quiet |

TABLE 3

Baseline ANN training order

| Test source | Distance to source (ft) | External ADC gain |
|---|---|---|
| Butane lighter | 0 | 0 |
| Butane lighter | 1 | 0 |
| Butane lighter | 3 | 0 |
| Butane lighter | 5 | 0 |
| Butane lighter | 17 | 3 |
| Propane torch | 5 | 0 |
| Propane torch | 10 | 0 |
| Propane torch | 20 | 3 |
| Butane lighter with flashlight | 5 | 0 |
| Butane lighter with random handwave | 5 | 0 |
| Rayovac industrial flashlight at 500 Watt | 0 | 0 |
| Rayovac industrial flashlight at 500 Watt | 1 | 0 |

TABLE 3-continued

Baseline ANN training order

| Test source | Distance to source (ft) | External ADC gain |
|---|---|---|
| Rayovac industrial flashlight at 500 Watt | 5 | 0 |
| Rayovac industrial flashlight at 500 Watt | 10 | 0 |
| TL 103 test lamp | 1 | 0 |
| TL 103 test lamp | 5 | 0 |
| TL 103 test lamp | 10 | 0 |
| TL 103 test lamp | 20 | 0 |
| Random hand waving | 1 | 0 |
| Random hand waving with industrial hotplate (Barnstead Intl. Thermolyne Cimarec 3) at 370 C. maximum | 5 | 0 |
| Random motion of the industrial hotplate (Cimarec 3) | 5 | 0 |
| Ambient background | — | 0 |
| Ambient background | — | 0 |
| Ambient background | — | 0 |
| Ambient background | — | 0 |
| Random hand waving | 5 | 0 |
| Arc welding with 6011 rod | 13 | 0 |
| Arc welding with 6012 rod | 13 | 0 |
| Arc welding with 6010 rod | 13 | 0 |
| Arc welding with 7018 rod | 13 | 0 |
| Arc welding with 7014 rod | 13 | 0 |
| Arc welding with 7018 rod | 9 | 0 |
| Arc welding with 7014 rod | 9 | 0 |
| Arc welding with 6012 rod | 9 | 0 |
| Arc welding with 6011 rod | 9 | 0 |
| Arc welding with 6010 rod | 9 | 0 |
| n-Heptane flame in 1' × 1' pan | 210 | 3 |
| n-Heptane flame in 1' × 1' pan | 210 | 3 |
| n-Heptane flame in 1' × 1' pan | 210 | 3 |
| n-Heptane flame in 1' × 1' pan | 210 | 3 |
| Vibration at 9 Hz 1 G along Y axis* | — | 3 |
| Vibration at 10 Hz 1 G along Y axis | — | 3 |
| Vibration at 13 Hz 1 G along Y axis | — | 3 |
| Vibration at 15 Hz 1 G along Y axis | — | 3 |
| Vibration at 18 Hz 1 G along Y axis | — | 3 |
| Vibration at 22 Hz 1 G along Y axis | — | 3 |
| Vibration at 25 Hz 1 G along Y axis | — | 3 |
| Vibration at 6 Hz, 1.24 mm displacement along Y axis | — | 3 |
| Vibration at 7 Hz, 1.24 mm displacement along Y axis | — | 3 |
| Vibration at 13 Hz, 0.5 G along Y axis | — | 3 |
| Vibration sweep 5–7 Hz, 0.5 G along Y axis | — | 3 |
| Vibration sweep 7–11 Hz, 0.5 G along Y axis | — | 3 |
| Vibration sweep 11–16 Hz, 0.5 G along Y axis | — | 3 |
| Vibration at 12 Hz, 0.5 G along Y axis | — | 3 |
| Vibration at 17 Hz, 0.5 G along Y axis | — | 3 |
| Vibration at 21 Hz, 0.5 G along Y axis | — | 3 |
| Vibration at 22 Hz, 0.5 G along Y axis | — | 3 |
| Vibration sweep 16–22 Hz, 0.5 G along Y axis | — | 3 |
| Vibration at 25 Hz, 0.5 G along Y axis | — | 3 |
| Vibration at 26 Hz, 0.5 G along Y axis | — | 3 |
| Vibration at 27 Hz, 0.5 G along Y axis | — | 3 |
| Vibration at 28 Hz, 0.5 G along Y axis | — | 3 |
| Vibration at 29 Hz, 0.5 G along Y axis | — | 3 |
| Vibration at 30 Hz, 0.5 G along Y axis | — | 3 |
| Vibration sweep 22–31 Hz, 0.5 G along Y axis | — | 3 |
| Vibration at 37 Hz, 0.5 G along Y axis | — | 3 |
| Vibration at 38 Hz, 0.5 G along Y axis | — | 3 |
| Vibration at 39 Hz, 0.5 G along Y axis | — | 3 |
| Vibration at 40 Hz, 0.5 G along Y axis | — | 3 |
| Vibration sweep 31–45 Hz, 0.5 G along Y axis | — | 3 |
| Vibration sweep 45–60 Hz, 0.5 G along Y axis | — | 3 |
| Vibration at 16 Hz, 0.5 G along Y axis | — | 3 |

TABLE 3-continued

Baseline ANN training order

| Test source | Distance to source (ft) | External ADC gain |
|---|---|---|
| Vibration at 14 Hz, 0.5 G along Y axis | — | 3 |
| Vibration at 32 Hz, 0.5 G along Y axis | — | 3 |
| Vibration at 33 Hz, 0.5 G along Y axis | — | 3 |
| Vibration at 34 Hz, 0.5 G along Y axis | — | 3 |
| Vibration at 19 Hz, 0.5 G along Y axis | — | 3 |
| Vibration at 20 Hz, 0.5 G along Y axis | — | 3 |
| Vibration at 21 Hz, 0.5 G along Y axis | — | 3 |
| Vibration sweep 4–60 Hz, 0.5 G along Y axis | — | 3 |
| Vibration sweep 4–60 Hz, 0.5 G along X axis | — | 3 |
| Vibration sweep 4–60 Hz, 0.5 G along negative Y axis | — | 3 |
| Vibration sweep 4–60 Hz, 0.5 G along Z axis | — | 3 |
| Oven heating at 60 C. | — | 3 |
| Oven heated at 85 C. | — | 3 |
| Oven heated at 85 C. | — | 3 |
| Oven heated at 85 C. | — | 3 |
| Oven heated at 85 C. | — | 3 |
| Oven heated at 85 C. | — | 3 |
| Ambient condition | — | 3 |
| Ambient condition | — | 3 |
| Random body motion | 7 | 0 |
| Random body motion | 5 | 3 |
| Ambient condition | — | 3 |
| Ambient condition | — | 3 |
| Flashing overlight in the oven at 81 C. temperature | — | 3 |
| Ambient condition | — | 3 |
| Sudden temperature change due to oven door opening | — | 3 |
| Rolling the unit cylinder around its axis | — | 3 |
| Oven heated at 85 C. | — | 3 |
| Ambient condition | — | 3 |
| Ambient condition | — | 3 |
| Ambient condition | — | 3 |
| Ambient condition | — | 3 |

An exemplary embodiment of a training data collection procedure involves the following four steps:

1. Collect data for some period of time, e.g. 30 seconds, using a LabView data collection program. The raw voltages are logged into a text file with predefined name. Optionally the ANN outputs can be logged per a currently trained network.

2. Format data for pre-processing and training programs, e.g. in MATLAB, a tool for doing numerical computations with matrices and vectors. The raw text file obtained through the LabView program can be edited with addition of target columns and the test name on each line. Data and target columns can be saved separately in comma delimited files (data.csv, target.csv) and imported into MATLAB for pre-processing and ANN training.

3. For each collected 30-second test, log the test condition information into a database, e.g. an Access database.

4. An IR signal strength chart can be generated for every test. This can identify, before training, whether or not the data will be useful for ANN training. For instance, if IR signal generated by lighting a butane lighter at 15 ft is as weak as IR signal in quiet condition, then butane lighter data might not be as helpful for ANN training. After the training data has been collected, it can be used for ANN/BP training, as described above regarding FIG. 8.

Figure 10:
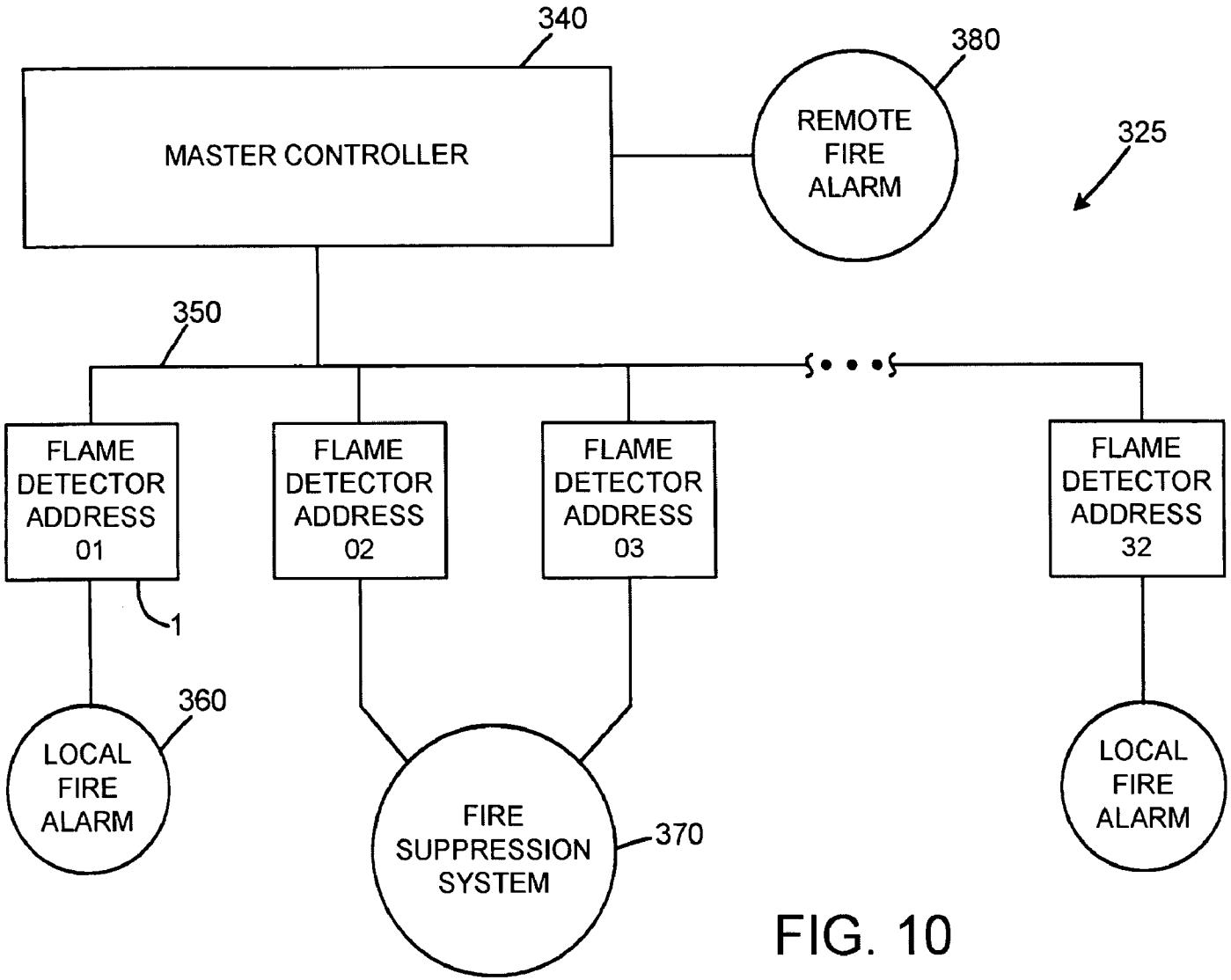
FIG. 10 is a system level block diagram of a flame detection system employing a plurality of flame detector systems.

FIG. 10 is a system level block diagram of a flame detection system 325 employing a plurality of flame detector systems 1. The flame detector systems 1 can be assigned individual addresses (e.g. 01, 02, 03 . . . ), and in this embodiment are connected to a master controller 340 by a serial communication data bus 350. In the event of a flame being detected by one or more of the flame detector systems 1, local fire alarms 360 and fire suppression systems 370 may be activated directly by the respective flame detector, e.g. via a relay, e.g. relay 25 (FIG. 1). Additionally, the master controller 340 may active a remote fire alarm 380.

Using a communication interface such as, MODBUS, HART, FieldBus, or Ethernet protocols operating over fiber optic, serial, infrared, or wireless media, the master controller may also reprogram the flame detectors 1 using the serial communications data bus 350, e.g. to update ANN coefficients.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A flame detection system, comprising:

a plurality of discrete optical radiation sensors;

means for joint time-frequency signal pre-processing outputs from the plurality of discrete optical radiation sensors to provide pre-processed signals;

an Artificial Neural Network for processing the pre-processed signals and providing an output indicating a flame condition;

said flame condition comprising the presence of flame or the absence of flame; and a fire alarm activated in response to an output indicating the presence of flame.

2. The system of claim 1, wherein the flame condition further comprises a false alarm condition.

3. The system of claim 1, wherein the plurality of optical radiation sensors comprises an array of discrete sensors.

4. The system of claim 3, wherein the array of discrete sensors are mounted in a unitary housing structure.

5. The system of claim 1, wherein the plurality of discrete optical radiation sensors comprises a 4.9 um sensor, a 2.2 um sensor, a 4.3 um sensor and a 4.45 um sensor.

6. The system of claim 1, wherein the Artificial Neural Network comprises a two-layer Artificial Neural Network.

7. The system of claim 1, wherein said pre-processing means establishes a correlation between frequency and time domain of the outputs from the discrete optical sensors.

8. The system of claim 7, wherein said means for establishing a correlation comprises an electronic signal processor adapted to perform one of Discrete Fourier Transform, Short-Time Fourier Transform with a shifting time window or a Discrete Wavelet Transform.

9. The system of claim 1, further comprising a temperature sensor for sensing a temperature of the system, and said Artificial Neural Network is further responsive to signals indicative of the sensed temperature to provide said output.

10. The system of claim 1, further comprising a vibration sensor for sensing a vibration level experienced by the system, and said Artificial Neural Network is further responsive to signals indicative of the sensed vibration level to provide said output.

11. A flame detection system, comprising:

a plurality of discrete optical radiation sensors; and an Artificial Neural Network for processing a plurality of signals indicative of outputs from the plurality of sensors and providing an output indicating a flame condition;

means for establishing a correlation between frequency and time domain of the outputs from the discrete optical sensors, wherein said means for establishing a correlation comprises an electronic signal processor adapted to perform one of Discrete Fourier Transform, Short-Time Fourier Transform with a shifting time window or a Discrete Wavelet Transform;

said flame condition comprising the presence of flame or the absence of flame; and a flame suppression system activated in response to an output indicating the presence of flame.

12. The system of claim 11, wherein the flame condition further comprises a false alarm condition.

13. The system of claim 11, wherein the plurality of optical radiation sensors comprises an array of discrete sensors.

14. The system of claim 13, wherein the array of discrete sensors are mounted in a unitary housing structure.

15. The system of claim 11, wherein the plurality of discrete optical radiation sensors comprises a 4.9 um sensor, a 2.2 um sensor, a 4.3 um sensor and a 4.45 um sensor.

16. The system of claim 11, wherein the Artificial Neural Network comprises a two-layer Artificial Neural Network.

17. The system of claim 11, further comprising a temperature sensor for sensing a temperature of the system, and said Artificial Neural Network is further responsive to signals indicative of the sensed temperature to provide said output.

18. A flame detection system, comprising:

a plurality of discrete sensors for generating a plurality of respective sensor signals, said plurality of sensors including a set of optical radiation sensors responsive to flame emissions;

a digital signal processor including an Artificial Neural Network (ANN) for processing the sensor signals to provide an output corresponding to a detector flame condition, said flame condition including the presence of flame or the absence of flame, the digital signal processor further comprising a pre-processing means for processing the sensor signals to provide pre-processed signals for said ANN, wherein said pre-processing means comprises means for establishing a correlation between frequency and time domain of the signals, said means performing one of Discrete Fourier Transform, Short-Time Fourier Transform with a shifting time window or a Discrete Wavelet Transform; and a flame suppression system activated by a detector flame condition corresponding to the presence of flame.

19. The system of claim 18, wherein the flame condition comprises a false alarm condition.

20. The system of claim 18, wherein the plurality of discrete sensors comprises an array of sensors mounted in a common housing structure.

21. The system of claim 20, wherein the set of optical radiation sensors comprises a 4.9 um sensor, a 4.3 um sensor and a 4.45 um sensor.

22. The system of claim 18, wherein the plurality of sensors further comprises an immunity sensor sensitive to radiation in an optical spectrum from ultraviolet to infrared.

23. The system of claim 22, wherein said immunity sensor is sensitive to 2.2 micron wavelength radiation.

24. The system of claim 18, wherein the plurality of sensors comprises a temperature sensor for generating a temperature sensor signal indicative of a temperature.

25. The system of claim 18, wherein the Artificial Neural Network comprises a two-layer Artificial Neural Network.

26. The system of claim 25, wherein the Artificial Neural Network comprises a hidden layer of artificial neurons which apply a set of hidden layer connection weights and a sigmoid function to said pre-processed signals to provide hidden layer output signals, and an output layer of output neurons which apply a set of output connection weights and a sigmoid function to said hidden layer output signals to provide flame neuron output values.

27. The system of claim 18, further comprising a decision processor responsive to outputs from the ANN to determine a flame detection state based on said sensor signals.

28. The system of claim 27, wherein the decision processor generates an alarm condition when a threshold limit is exceeded.

29. A method for detecting flames, comprising:

sensing optical radiation over a field of view with a plurality of discrete sensors and generating sensor signals indicative of the sensed radiation;

establishing a correlation between frequency and time domain of the sensor signals, wherein said establishing a correlation comprises performing one of Discrete Fourier Transform, Short-Time Fourier Transform with a shifting time window or a Discrete Wavelet Transform;

processing the sensor signals by a digital signal processor including an Artificial Neural Network (ANN) to provide detection outputs corresponding to a flame condition, said flame condition comprising the presence of flame or the absence of flame; and activating a fire alarm in the event of a detection output corresponding to the presence of flame.

30. The method of claim 29, wherein the flame condition comprises a false alarm condition.

31. The method of claim 29, wherein the plurality of optical radiation sensors comprises a 4.9 um sensor, a 2.2 um sensor, a 4.3 um sensor and a 4.45 um sensor.

32. The method of claim 29, wherein the artificial neural network comprises a two-layer Artificial Neural Network.

33. A flame detection system, comprising:

a plurality of discrete optical radiation sensors;

means for joint time-frequency signal pre-processing outputs from the plurality of discrete optical radiation sensors to provide pre-processed signals;

a digital signal processor for processing the pre-processed signals to detect a flame in a field of view surveilled by said plurality of discrete optical radiation sensors, and providing an output indicating a flame condition;

a fire alarm system activated in response to an output indicating that a flame has been detected in said field of view.

34. The system of claim 33, wherein the flame condition comprises one of the presence of flame, the absence of flame and false alarm.

35. The system of claim 33, wherein the flame condition is one of the presence and the absence of flame.

36. The system of claim 33, wherein the plurality of optical radiation sensors comprises an array of discrete sensors.

37. The system of claim 33, wherein the plurality of discrete optical radiation sensors comprises a 4.9 um sensor, a 2.2 um sensor, a 4.3 um sensor and a 4.45 um sensor.

38. The system of claim 33, wherein the digital signal processor comprises an Artificial Neural Network.

39. The system of claim 33, wherein said pre-processing means establishes a correlation between frequency and time domain of the outputs from the discrete optical sensors.

40. The system of claim 39, wherein said pre-processing means is adapted to perform one of Discrete Fourier Transform, Short-Time Fourier Transform with a shifting time window or a Discrete Wavelet Transform.

41. The system of claim 1, further comprising a flame suppression system activated in response to an output indicating the presence of flame.

42. The method of claim 29, further comprising:

activating a flame suppression system in response to an output indicating the presence of flame.

43. The system of claim 33, further comprising a flame suppression system activated in response to an output indicating that a flame has been detected within said field of view.

* * * * *